United States Patent [19]

Suzuki et al.

[11] 4,446,838

[45] May 8, 1984

[54] EVAPORATIVE EMISSION CONTROL SYSTEM

[75] Inventors: Mikio Suzuki, Zushi; Masafumi Yamazaki, Yokosuka, both of Japan

[73] Assignee: Nissan Motor Co., Ltd., Kanagawa, Japan

[21] Appl. No.: 445,838

[22] Filed: Nov. 30, 1982

[30] Foreign Application Priority Data

Dec. 1, 1981 [JP] Japan ..... 56-177732 [U]

[51] Int. Cl.[3] ..... F02M 33/02

[52] U.S. Cl. ..... 123/520; 123/519

[58] Field of Search ..... 123/520, 518, 519, 521, 123/DIG. 2, 516

[56] References Cited

U.S. PATENT DOCUMENTS

| | | | |
|---|---|---|---|
| 4,085,721 | 4/1978 | Vardi et al. | 123/520 |
| 4,308,842 | 1/1982 | Watanabe et al. | 123/520 |
| 4,318,383 | 3/1982 | Iritani et al. | 123/520 |

FOREIGN PATENT DOCUMENTS

| | | | |
|---|---|---|---|
| 56-77545 | 6/1981 | Japan | 123/519 |
| 57-5539 | 1/1982 | Japan | 123/519 |
| 57-129247 | 8/1982 | Japan | 123/519 |

*Primary Examiner*—Ira S. Lazarus
*Assistant Examiner*—Magdalen Moy
*Attorney, Agent, or Firm*—Lowe, King, Price & Becker

[57] ABSTRACT

In an evaporative emission control system of a motor vehicle, a two way valve is provided for connecting the canister with the air-fuel mixture intake tube of the engine when assuming a first position and connecting the canister with the clean side of the air cleaner when assuming a second position. The two way valve assumes the first position when the interior condition of the fuel tank does not tend to saturate the vapor adsorbing power of the canister, and assumes the second position when the interior condition of the fuel tank tends to saturate the vapor adsorbing power of the canister.

7 Claims, 13 Drawing Figures

EVAPORATIVE EMISSION CONTROL SYSTEM

BACKGROUND OF THE INVENTION

1. Field of the Invention

The present invention relates in general to an antipollution system and more particularly to an evaporative emission control system of a motor vehicle.

2. Description of the Prior Art

Nowadays, motor vehicles are equipped with an evaporative emission control system which prevents the escape of fuel (gasoline) vapors from the fuel tank and carburetor, whether or not the engine is running. Usually, the system uses an activated charcoal canister to trap the vapors when the engine is shut off. On restarting, flow of filtered air through the canister purges the vapors from the charcoal, and the mixture goes through purge tubes into the carburetor to be burned in the engine.

Some of the conventional systems, however, do not take a satisfied measure to deal with a saturated condition of the canister. In fact, once the activated charcoal of the canister is saturated in adsorbing the fuel vapors, very rich mixture (or vapors) is produced in the purge tubes or lines thereby causing the engine air-fuel mixture to become greatly rich. This phenomenon not only deteriorates the exhaust characteristics but also lowers the fuel economy of the engine. This drawback will be well understood from an after description where one of the conventional emission control systems is described.

BRIEF DESCRIPTION OF THE DRAWINGS

Objects and advantages of the present invention will become apparent from the following description when taken in conjunction with the accompanying drawings, in which.

DETAILED DESCRIPTION OF THE INVENTION

Prior to describing the invention, one of conventional evaporative emission control systems will be described with reference to FIG. 1 in order to clarify the invention.

Figure 1:
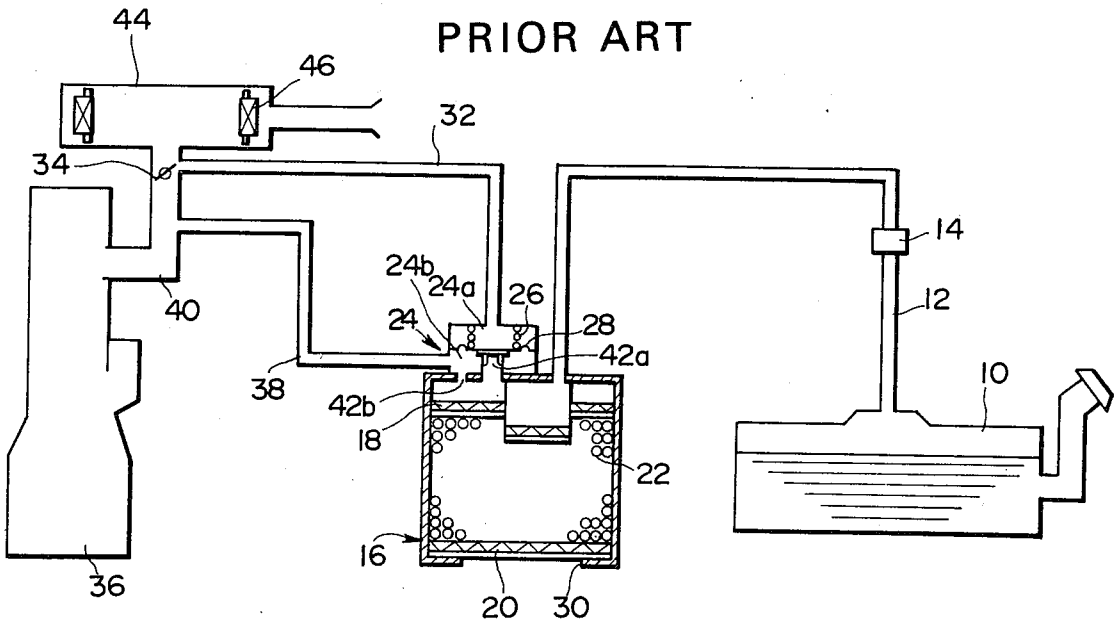
FIG.1 PRIOR ART
FIG. 1 is a schematic illustration of a conventional evaporative emission control system.

Referring to FIG. 1, there is shown a conventional evaporative emission control system. Fuel vapors from a fuel tank 10 pass through a fuel vent line 12 and a liquid check valve 14 and are trapped by a vapor storage canister 16. The canister 16 includes filters 18 and 20, activated charcoal particles 22 packed in the case between filters 18 and 20, and a purge control valve 24. The purge control valve 24 has a spring 26 and a diaphragm 28 which are assembled in the illustrated conventional manner. The canister 16 has an air intake opening 30 to which the filter 20 is exposed.

Into the vacuum chamber 24*a* of the purge control valve 24 is applied, through a signal vacuum line 32, a vacuum created at a throttle valve 34 of the carburetor of the internal combustion engine 36. A purge line 38 connects the air-fuel mixture intake tube 40 of the engine 36 with the canister open portion of the valve 24. Designated by numeral 42*a* is an ON-OFF type purge orifice, and 42*b* is a fixed purge orifice. Denoted by numeral 44 is an air cleaner body in which a filter element 46 is disposed.

When the engine 36 is out of operation, the purge orifice 42*a* closes by the action of the spring 26. Even though, under this condition, the communication between the mixture intake tube 40 and the canister 16 is kept through the fixed orifice 42*b*, the canister 16 is not purged because of absence of negative pressure in the intake tube 40. Under this condition, the fuel vapors produced in the fuel tank 10 are introduced through the fuel vent line 12 and the liquid check valve 14 into the canister 16 and trapped by the same.

When the engine 36 is idling or undergoing deceleration, the negative pressure at the throttle valve 34 is quite low or substantially zero thereby keeping the diaphragm 28 closing the openable purge orifice 42*a* by the action of the spring 26. With the openable purge orifice 42*a* thus kept in its close position, a flow of filtered air through the canister 16 purges the vapors from the activated charcoal particles 22 of the canister 16, and the mixture goes through the fixed purge orifice 42*b* and the purge line 38 feeding into the air-fuel mixture intake tube 40 to be burned in the engine 36.

When the engine 36 is operating with the throttle valve 34 largely open, the negative pressure applied to the vacuum chamber 24*a* of the valve 24 is high and thus, the diaphragm 28 is lifted apart from the openable purge orifice 42*a* against both the force created by the negative pressure in the intake tube 40 and that created by the spring 26. With this, the openable purge orifice 42*a* becomes open thereby reducing the passage resistance between the canister 16 and the intake tube 40. Thus, much air is introduced through the canister air intake opening 30 into the canister 36, purging from the activated charcoal particles 22 correspondingly greater amount of vapors which are then introduced into the intake tube 40 through the two purge orifices 46*a* and 46*b*.

When, however, a highly volatile combustible liquid, such as methanol or methanol-gasoline mixture, is used for the fuel of the engine 36, a greater amount of vapors are inevitably produced in the fuel tank 10 in comparison with the case of using only gasoline. Thus, when using such a highly volatile fuel, there is a high possibility of saturating the adsorption power of the activated charcoal particles 22 in a shortened period of time against the fuel vapors. When the canister 16 comes to the power limit, part of fuel in the canister 16 condences and gathers at the depth of the canister 16 causing the fuel or mixture carried by the purge line 38 to be greatly increased. Thus, under this condition, the air-fuel mixture to be fed into the engine 36 becomes abnormally rich thereby deteriorating not only the exhaust gas characteristic but also the fuel economy.

Thus, it is an essential object of the present invention to provide a measure which solves the abovementioned drawbacks.

In the following, the present invention will be described in detail with reference to the drawings. In the drawings, identical parts and constructions to those of the conventional system of FIG. 1 are designated by the same numerals, and in the following description, explanation of them will be omitted.

Figure 2:
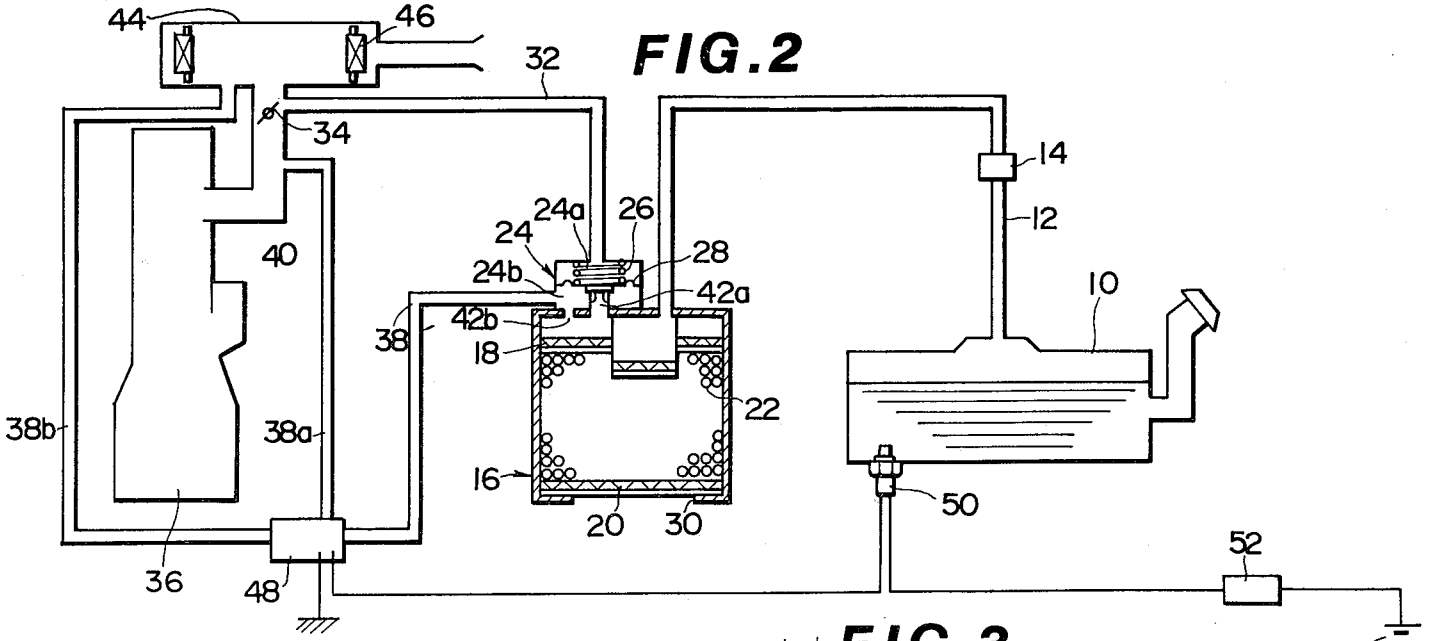
FIG. 2 is a schematic illustration of an evaporative emission control system of a first embodiment according to the present invention.

Referring to FIG. 2, there is shown an evaporative emission control system of a first embodiment of the present invention. In the first embodiment, the purge line 38 from the purge control valve 24 leads to an electromagnetic switch valve 48 from which two purge lines 38*a* and 38*b* extend to the air-fuel mixture intake tube 40 and a clean side of the air cleaner 44, respectively. At the bottom of the fuel tank 10, there is disposed a fuel temperature sensor 50 which senses the temperature of the fuel in the fuel tank 10 for controlling the operation of the switch valve 48. The sensor 50 may be a switch which assumes its ON-condition when the temperature of the fuel is higher than a predetermined level, and assumes its OFF-condition when the fuel temperature is lower than the predetermined level. Designated by numeral 52 is a switch synchronously operable with a known ignition switch (not shown), which is electrically connected with the fuel temperature sensor 50, the switch valve 48 and a battery 54, as shown.

Figure 3:
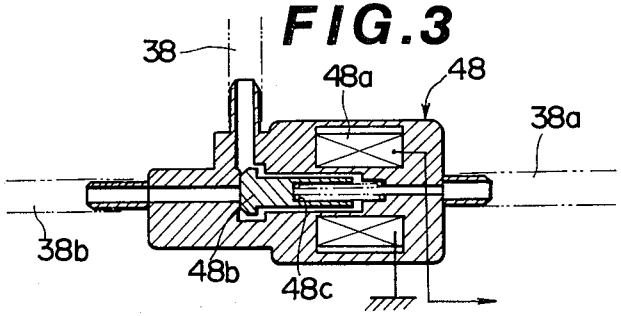
FIG. 3 is a sectional view of a switch valve employed in the present invention.

As is well shown in FIG. 3, the switch valve 48 is an electromagnetically operated two-way valve which is constructed and arranged so that when electrically deenergized, only the communication between the line 38 and the line 38*a* is completed, while, when electrically energized, only the communication between the line 38 and the line 38*b* is completed. The switch valve 38 comprises a body having three passages respectively connected to the line 38, 38*a* and 38*b*, a coil 48*a* arranged about the passage associated with the line 38*a*, a valve proper 48*b* slidably disposed in an enlarged bore of the passage, and a spring 48*c* biasing the valve proper 48*b* in a direction to close the passage associated with the line 38*b*.

With the above-stated construction, it will be appreciated that when either one of the temperature sensor 50 and the switch 52 assumes OFF-position, the switch valve 48 provides only the communication between the air-fuel mixture intake tube 40 and the canister 16.

Figure 7:
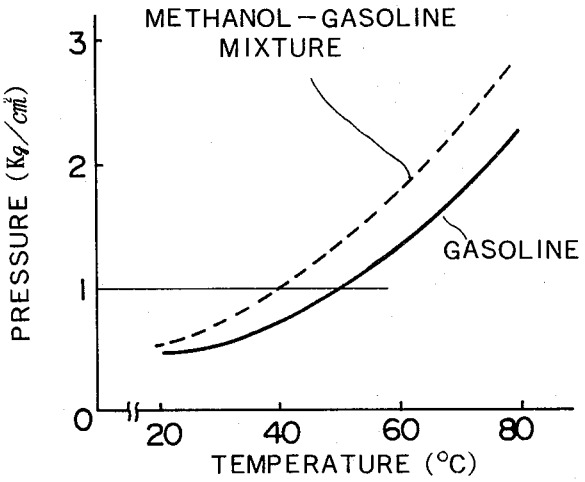
FIG. 7 is a graph showing volatility of fuels used with respect to temperature.

Prior to describing the operation of the system of the first embodiment, volatility of fuels with respect to temperature at which the fuels are heated will be outlined with reference to the graph of FIG. 7. This graph shows the volatility of gasoline and that of methanol-gasoline mixture, by depicting the relationship between the fuel temperature and the pressure in the fuel tank 10. As is understood from this graph, the volatility of the methanol-gasoline mixture is higher than that of the gasoline and increases remarkably with increase of temperature of the mixture. Thus, by measuring the temperature of the fuel in the fuel tank 10, the volatility of the fuel in the tank 10, that is, the amount of vapors in the fuel tank 10 can be sensed.

When, in operation, a part of the fuel in the fuel tank 10 is evaporated by heat from the outside, the pressure of the vapors thus created in the tank 10 increases. When the vapor pressure in the tank 10 exceeds a predetermined level, the liquid check valve 14 opens the fuel vent line 12 thus introducing the vapors into the canister 16 where the vapors are adsorbed by the activated charcoal particles 22.

When sensing the saturated condition of the canister 16 by sensing the fuel temperature higher than the predetermined level, the temperature sensor 50 closes its circuit, so that, under running of the engine 26 (which means the close condition of the switch 52), the switch valve 48 provides only the communication between the line 38 and the line 38*b*. Thus, under this condition, the vapors purged from the adsorbent particles 22 in the canister 16 are introduced through the line 38*b* into the clean side of the air cleaner 44.

It is now to be noted that in general, under running of the engine 36, the negative pressure or vacuum at the clean side of the air cleaner 44 is quite low as compared with that at the intake tube 40. This means that the vapor suction effect at the air cleaner clean side is lower than that at the intake tube 40. Thus, even when the excessively rich mixture is provided in the canister 16, the line 38*b* carries only a small amount of vapors to the air cleaner clean side. Thus, the air-fuel mixture actually fed to the engine 36 is prevented from becoming excessively rich.

Figure 8:
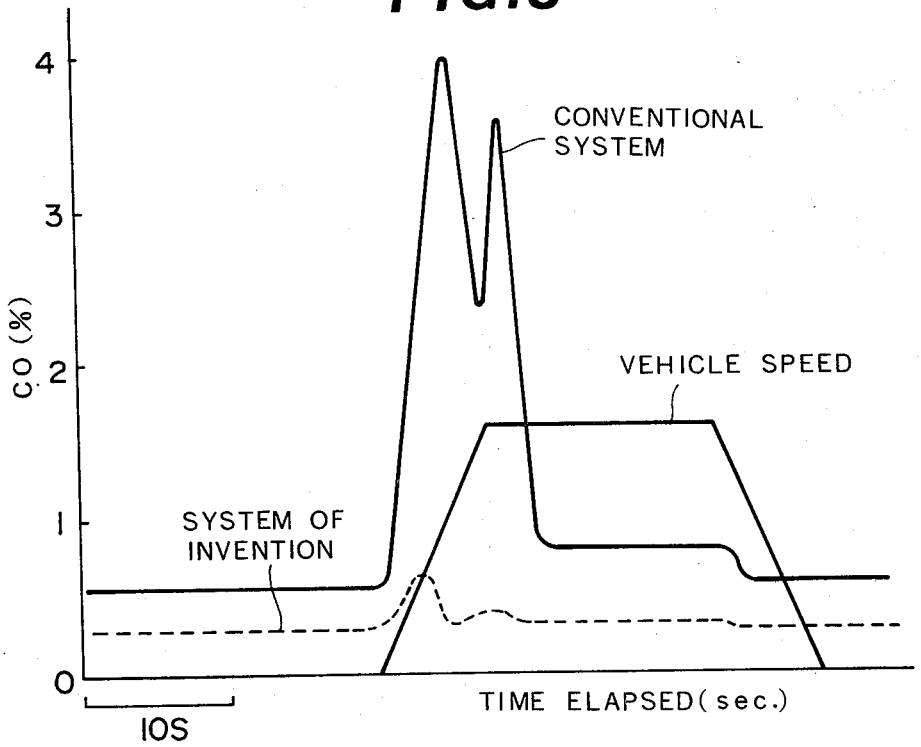
FIG. 8 is a graph showing CO concentration of the exhaust gas emitted from an engine equipped with the evaporative emission control system of the invention.

This fact will be well understood from the graph of FIG. 8 which shows the characteristics of the conventional system of FIG. 1 and that of the invention of FIG. 2, by depicting CO concentration of the exhaust gas emitted from respective engines equipped with these systems. As is seen from this graph, the system of the invention shows only a small or negligible increase of CO concentration in the exhaust gas at the saturated condition of the canister 16, while the conventional system shows a sharp increase of the CO-concentration. This means that the air-fuel mixture fed to the engine equipped with the system of the present invention has a quite high stability in air-fuel ratio even at the saturated condition of the canister, as compared with the engine equipped with the conventional system.

Figure 4:
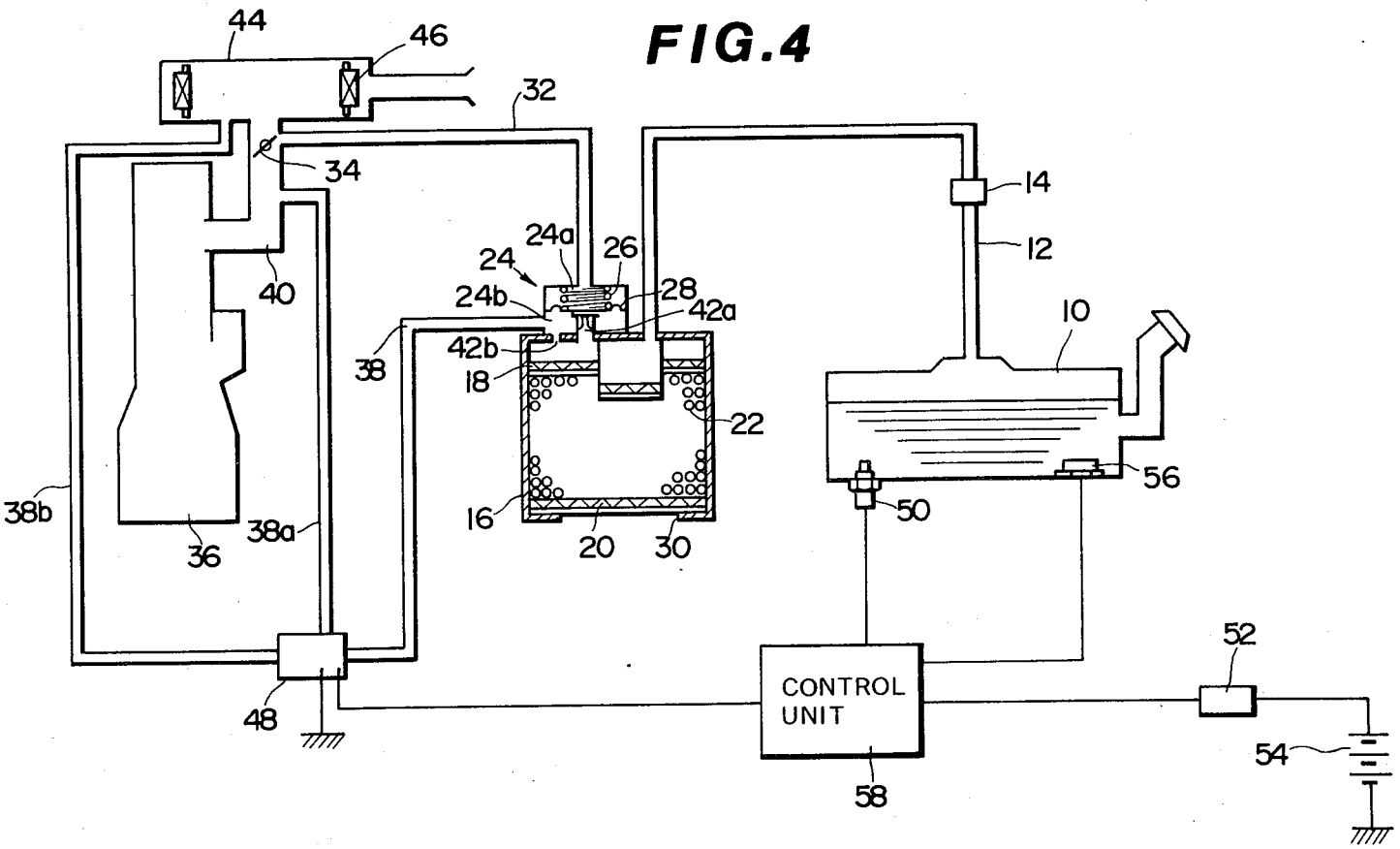
FIG. 4 is a view similar to FIG. 2, but showing a second embodiment of the present invention.
Figure 9:
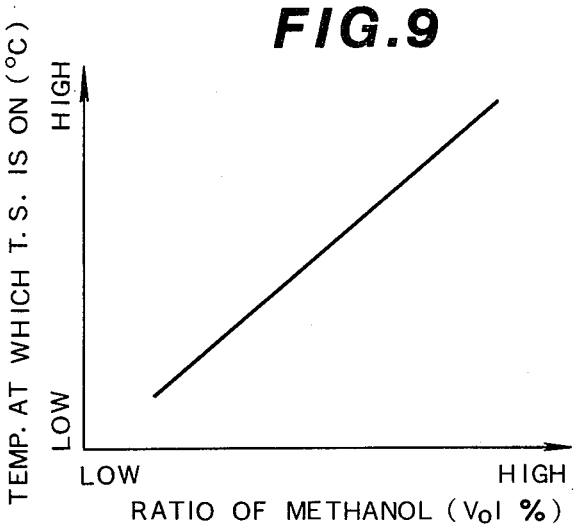
FIG. 9 is a graph showing the relationship between the methanol ratio in the methanol-gasoline mixture and the temperature at which a fuel temperature sensor employed in the second embodiment assumes its ON-condition.
Figure 10:
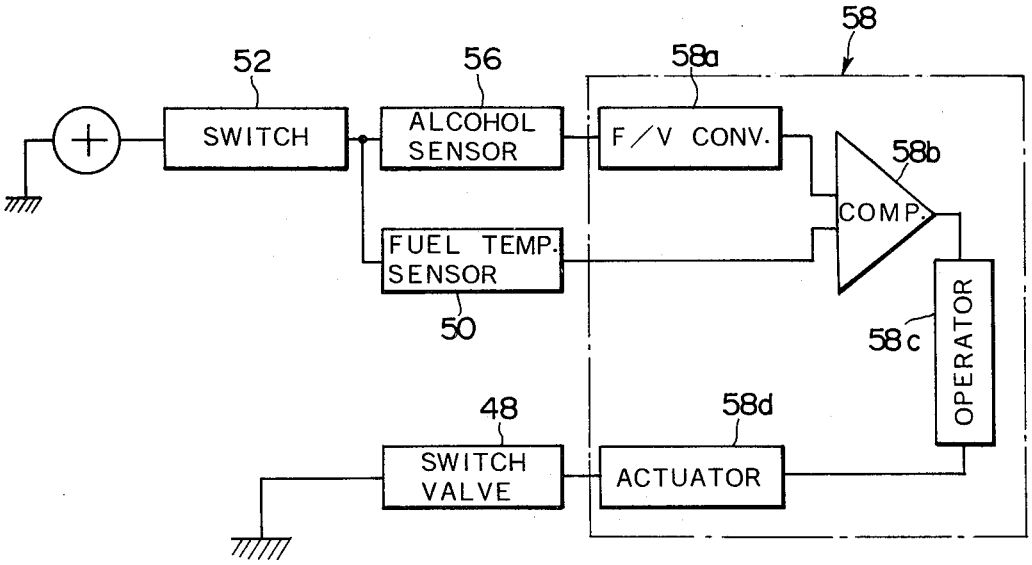
FIG. 10 is a circuit diagram of a control unit employed in the system of second embodiment.

Referring to FIG. 4, there is shown a second embodiment of the present invention. In this embodiment, an alcohol sensor 56 is added, which is disposed at the bottom of the fuel tank 10 and senses the concentration of alcohol in the fuel for the purpose of changing the sensitivity of the fuel temperature sensor 50. A control unit 58 is arranged in the circuit for controlling the operation of the switch valve 48 in accordance with the output signals emitted from the fuel temperature sensor 50 and the alcohol sensor 56. The circuit of the control unit 58 is shown by FIG. 10. The frequency output from the alcohol sensor 56 is converted to a voltage signal by a F/V converter 58*a*. The voltage signal from the F/V converter 58*a* is fed to a comparator 58*b* to be compared with another voltage signal emitter from the fuel temperature sensor 50. The control unit 58 is so designated that the temperature at which the fuel temperature sensor 56 assumes its ON-condition increases with increase of the alcohol concentration of the fuel in the fuel tank 10. Experiment has revealed that the temperature at which the pressure in the fuel tank 10 containing therein a 15% methanol-85% gasoline mixture indicates 1.0 kg/cm$^2$ is ten degrees lower than that in case of 100% gasoline. This fact will be understood from the graph of FIG. 9, which shows the relationship between the methanol ratio in the methanol-gasoline mixture and the temperature of the fuel at which the fuel temperature sensor 50 assumes its ON-condition.

Figure 5:
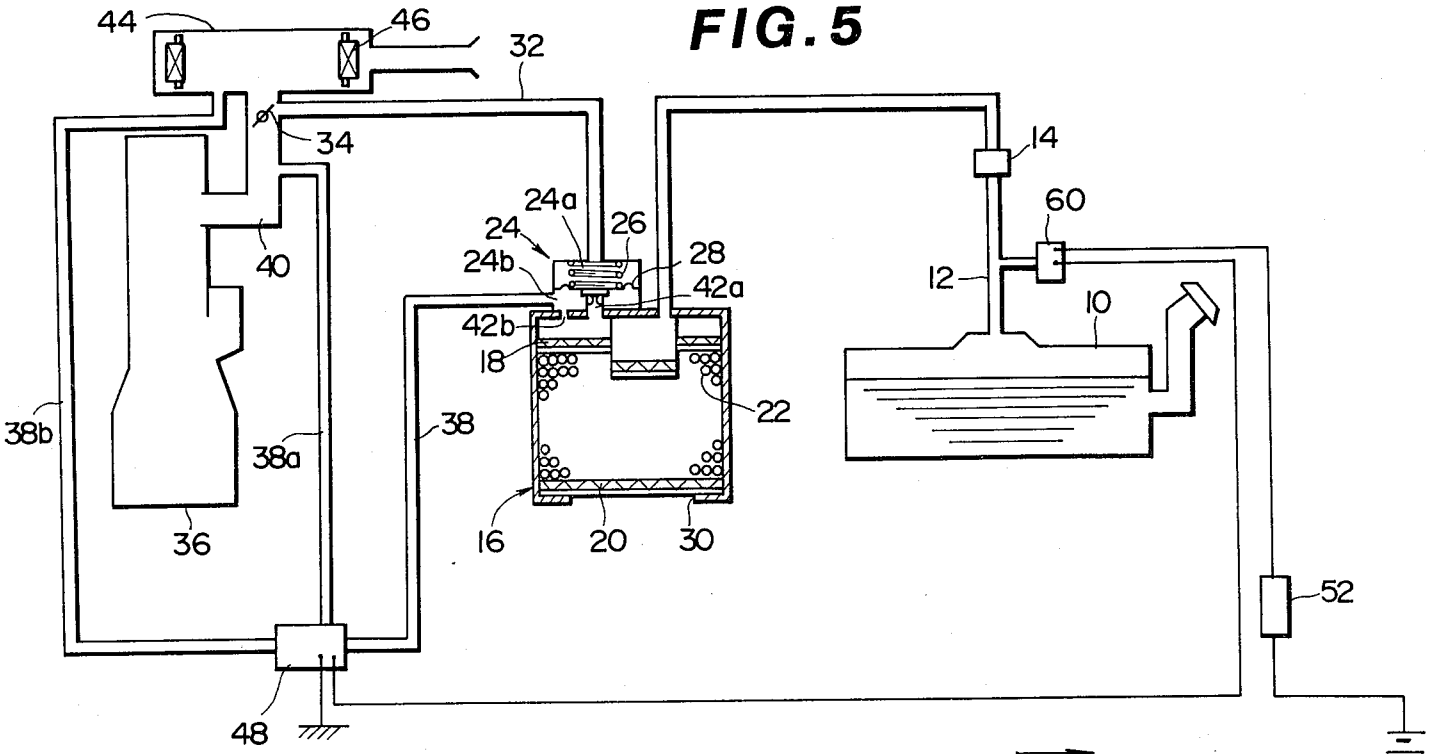
FIG. 5 is a view similar to FIG. 2, but showing a third embodiment of the present invention.
Figure 6:
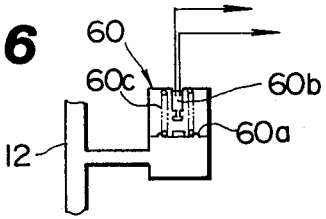
FIG. 6 is a sectional view of a pressure sensor employed in the system of the third embodiment of FIG. 5.

Referring to FIG. 5, there is shown a third embodiment of the present invention. In this embodiment, a pressure sensor 60 is disposed to the fuel vent line 12 at the position between the liquid check valve 14 and the fuel tank 10, which controls the operation of the switch valve 48 in accordance with the pressure in the fuel tank 10. Of course, the pressure sensor 60 may be mounted at the upper portion of the fuel tank 10. As is shown by FIG. 6, the pressure sensor 60 comprises a casing, and a diaphragm 60*a* disposed in the casing to divide the same into two chambers. One chamber is connected to the interior of the fuel vent line 12, while the other chamber is open to the atmosphere. Within the open chamber is disposed a micro-switch 60*b* which is electrically connected to the switch 52 and the switch valve 48. Disposed about the micro-switch 60*b* is a coil spring 60*c* which biases the diaphgram 60*a* away from the micro-switch 60*b*. With this, when the pressure in the fuel tank 10 increases and reaches a predetermined level, the diaphragm 60*a* is brought into contact with the micro-switch 60*b* to cause the same to assume the ON-position.

Figure 11:
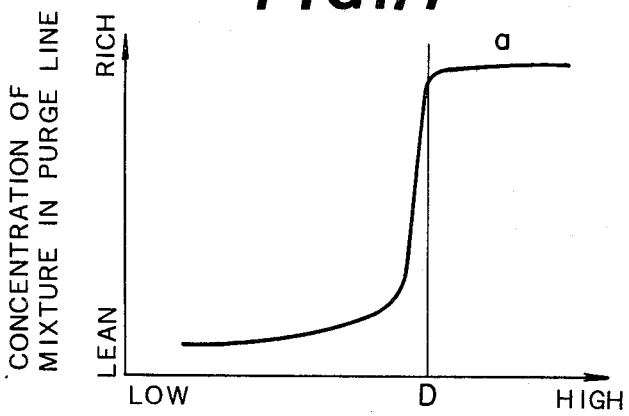
FIG. 11 is a graph showing the concentration of mixture in purge line with respect to the pressure in the fuel tank.
Figure 12:
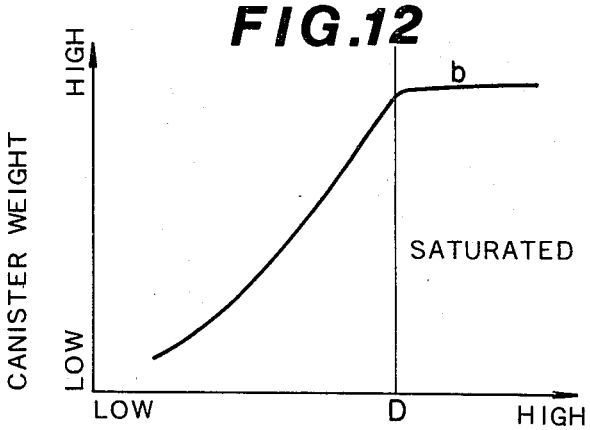
FIG. 12 is a graph showing the relationship between the pressure in the fuel tank and the weight of the canister.
Figure 13:
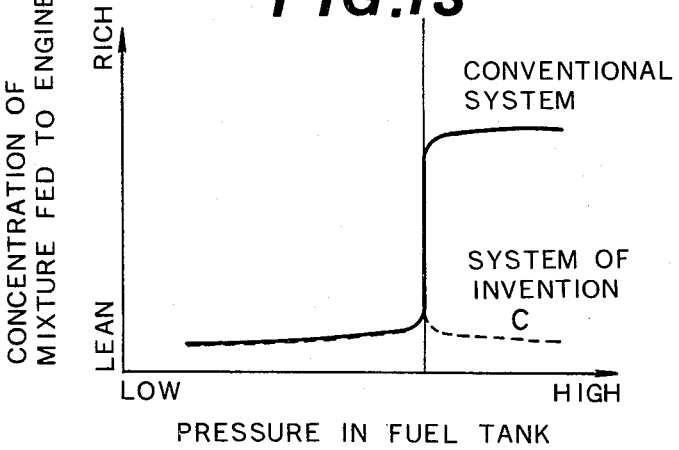
FIG. 13 is a graph showing the concentration of the mixture directly fed to the engine with respect to the pressure in the fuel tank.

When the vapors in the fuel tank 10 increase, the pressure in the same also increases and, finally, the canister 16 comes to its saturated condition. This phenomenon will be seen from the graph of FIG. 12 which shows the relationship between the pressure in the fuel tank 10 and the weight of canister 16 (Adsorbed vapors increase the weight of the canister 16). Point D indicates the saturated condition of the activated charcoal particles 22 of the canister 16. When the canister 16 is saturated, the mixture or vapor in the purge line 38 becomes excessively rich as is understood from the graph of FIG. 11 which shows the concentration of the mixture in the purge line 38 with respect to the pressure in the fuel tank 10. Now, when, in the third embodiment of FIG. 5, the pressure in the fuel vent line 12, that is the pressure in the fuel tank 10, exceeds a predetermined level, the pressure sensor 60 assumes its ON condition causing the switch valve 48 to provide only the communication between the line 38 and the line 38*b* feeding the air cleaner clean side with the abnormally rich mixture from the canister 16. However, by the reason which has been described hereinabove, only a small amount of vapors or mixture is carried by the line 38*b*, so that the air-fuel mixture actually fed to the engine proper is prevented from becoming remarkably rich, as is understood from the graph of FIG. 13 which shows the concentration of the mixture directly fed to the engine 36 with respect to the pressure in the fuel tank 10.

As is described hereinabove, in accordance with the present invention, there is proposed a measure in which when the amount of vapors in the fuel tank 10 exceeds a predetermined level, a switch valve provides only a communication between the canister 16 and the air cleaner clean side where the vapor suction effect is relatively low. Thus, under this condition, only a small amount of purged vapor from the canister 16 is fed to the engine 36 without effecting the air-fuel ratio of the mixture actually fed to the engine 16. Thus, the drawbacks, such as deterioration of the exhaust gas characteristics and deterioration of the fuel economy which have been encountered in the conventional system of FIG. 1, are solved by the present invention.

What is claimed is:

1. In a motor vehicle having an engine, an air cleaner connected to said engine through an intake tube, and a fuel tank, an evaporative emission control system comprising:

a fuel vapor adsorbing canister connected to said fuel tank through a fuel vent tube;

a purge control valve connected to said canister and adapted to be responsive to the induction vacuum prevailing in said intake tube;

a two way valve;

a first conduit leading from said purge control valve to said two way valve;

a second conduit leading from said two way valve to said intake tube;

a third conduit leading from said two way valve to the clean side of said air cleaner;

said two way valve connecting said first and second conduits when assuming a first postion, and connecting said first and third conduits when assuming a second position;

a control circuit operatively connected to said two way valve, said control circuit including means for sensing a parameter indicative of said fuel vapor adsorbing canister being saturated and unable to adsorb any further fuel vapor, said control circuit being adapted to induce said two way valve to assume said second position thereof upon said means sensing a saturated condition of said fuel vapor adsorbing canister.

2. An evaporative emission control system as claimed in claim 1, in which said means of said control circuit comprises a temperature sensor for sensing the temperature of the fuel in the fuel tank, said sensor functioning to induce said two way valve to assume said second position when sensing that the fuel temperature is higher than a predetermined level.

3. An evaporative emission control system as claimed in claim 1, in which said means of said control circuit comprises:

a temperature sensor for sensing the temperature of the fuel in the fuel tank;

a concentration sensor for sensing the concentration of a high volatile liquid contained in the fuel; and a control unit for controlling the operation of said two way valve in accordance with the information signals emitted from said temperature sensor and said concentration sensor, said control unit being so designed that the temperature at which said temperature sensor assumes its ON-condition to induce the second position of said two way valve lowers with increase of the high volatile liquid concentration of the fuel.

4. An evaporative emission control system as claimed in claim 3, in which said concentration sensor is an alcohol sensor which senses the concentration of alcohol in the fuel.

5. An evaporative emission control system as claimed in claim 1, in which said means of said control circuit comprises a pressure sensor which senses the pressure in said fuel tank, said pressure sensor functioning to induce said two way valve to assume said second position when sensing that the pressure in the fuel tank exceeds a predetermined level.

6. An evaporative emission control system as claimed in claim 1, in which said two way valve is an electromagnetically operated valve which comprises:

a body having first, second and third passages which are respectively connected to said first, second and third conduits;

a valve proper slidably received in an enlarged section of said first passage;

a spring biasing said valve proper in a direction to provide a communication between said first and second passages; and a coil disposed about said first passage and attracting, when electrically energized, said valve proper against the biasing force of said spring to provide a communication between said first and third passages.

7. An evaporative emission control system as claimed in claim 5, in which said pressure sensor comprises:

a casing;

a diaphragm disposed in said casing to divide the same into first and second chambers, said first chamber being connected to the interior of said fuel tank, while said second chamber being open to the atmosphere;

a spring biasing said diaphragm in a direction to contract said first chamber; and a micro-switch disposed in said second chamber and assuming its ON-condition when said diaphragm is brought into engagement with said switch.

* * * * *